US008882173B2

(12) United States Patent
Thorpe et al.

(10) Patent No.: US 8,882,173 B2
(45) Date of Patent: Nov. 11, 2014

(54) SUPPORT MECHANISM FOR A VEHICLE CLOSURE PANEL

(71) Applicant: GM Global Technology Operations LLC, Detroit, MI (US)

(72) Inventors: Scott W. Thorpe, Milford, MI (US); Henry J. Nykiel, Howell, MI (US); Himanshu H. Mehta, Ann Arbor, MI (US); Peter M. Snede, Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/794,928

(22) Filed: Mar. 12, 2013

(65) Prior Publication Data

US 2014/0259941 A1 Sep. 18, 2014

(51) Int. Cl.
*E05F 5/08* (2006.01)
*E05F 1/10* (2006.01)

(52) U.S. Cl.
CPC ..... *E05F 1/10* (2013.01)
USPC ..... 296/146.11; 16/277; 16/280; 16/362

(58) Field of Classification Search
CPC ..... B62D 25/10; B62D 25/12; B62D 25/105; B60J 5/047; B60J 5/0472; B60J 5/0473; B60J 5/10; E05D 5/043; E05D 5/062; E05D 13/10; E05D 13/123; E05D 7/086; E05D 11/08; E05D 11/087; E05D 11/1057; E05F 3/16; E05F 3/20
USPC ..... 296/76, 92, 112, 146.1, 146.8, 146.11; 16/221, 225, 277, 280, 289, 303, 321, 16/334, 362; 49/386, 502
See application file for complete search history.

(56) References Cited

U.S. PATENT DOCUMENTS

| | | | | |
|---|---|---|---|---|
| 3,146,487 | A * | 9/1964 | Nelson et al. | 16/337 |
| 4,206,944 | A * | 6/1980 | Kumagai et al. | 296/76 |
| 6,453,511 | B2 * | 9/2002 | Sato | 16/360 |
| 6,568,033 | B2 * | 5/2003 | Kim | 16/334 |
| 7,774,900 | B2 * | 8/2010 | Shaw | 16/343 |
| 7,900,322 | B2 * | 3/2011 | Doring et al. | 16/362 |
| 2001/0005920 | A1 * | 7/2001 | Kim | 16/334 |
| 2006/0053589 | A1 * | 3/2006 | Vanini | 16/286 |
| 2007/0256277 | A1 * | 11/2007 | Shaw | 16/343 |

* cited by examiner

*Primary Examiner* — Glenn Dayoan
*Assistant Examiner* — Jason S Daniels
(74) *Attorney, Agent, or Firm* — Quinn Law Group, PLLC

(57) ABSTRACT

A support mechanism for a vehicle closure panel is provided. The support mechanism includes a connection rod and a counterbalancing device. The connection rod is configured to secure the closure panel in a second position and control the speed of the closure panel as it moves between a first position and a second position. The counter balancing device includes a connection rod base structure, at least one guide block, of a first material, at least one resistance member, of a second material, and at least one spring element. The guide block interacts with the resistance member. The interaction of the first material of the guide block and the second material of the resistance member creates a resistance force of variable force output to counterbalance the weight of the closure panel as the closure panel moves between the first position to the second position.

16 Claims, 4 Drawing Sheets

SUPPORT MECHANISM FOR A VEHICLE CLOSURE PANEL

TECHNICAL FIELD

The disclosure relates to a support mechanism for a vehicle closure panel. More particularly the disclosure relates to a prop rod system for use with a vehicle hood, trunk, liftgate, or tailgate.

BACKGROUND

Numerous motor vehicles employ a hingable closure panel disposed in a region between the passenger compartment and the forward bumper of the motor vehicle, or between the passenger compartment and the rearward bumper of the motor vehicle. The hingable closure panel provides a mechanism for accessing the underlying engine or storage compartment.

Some closure panels employ a prop rod or other mechanism to hold the closure panel in an open position. Such mechanisms may include a traditional prop arm or conventional pneumatic or gas-charged struts.

SUMMARY

A support mechanism for a closure panel of a vehicle body, such as a hood, rear hatch closure panel, trunk, liftgate, tailgate, or the like is provided. The closure panel is moveable with respect to the vehicle body from a first position to a second position. The support mechanism secures the closure panel in the second position. The support mechanism may be a hood prop rod system or the like.

The support mechanism includes a connection rod assembly and a counterbalancing device. The connection rod assembly includes a connection rod and a connection rod base structure. The connection rod is pivotally connected to the closure panel at a first attachment point and pivotally connected to the connection rod base structure at a second attachment point. The connection rod base structure is configured to move linearly with respect to the first attachment point.

The counterbalancing device includes at least one guide block and at least one resistance member. The counterbalancing device may also include at least one spring element.

The at least one guide block is coupled to the connection rod base structure for movement therewith. The at least one guide block engages the at least one resistance member creating an interaction therebetween. The interaction between the at least one guide block and the at least one resistance member creates a resistance force sufficient to counter balance the closure panel as the connection rod base structure moves linearly with respect to the first attachment point.

The speed at which the closure panel moves between the first position and the second position is defined by the interaction between the at least one guide block the at least one resistance member.

The at least one spring element is biasingly positioned with respect to the at least one resistance member. Each spring element defines at least one detent along the length of each resistance member to bias the at least one resistance member against the at least one guide block. The counterbalancing force applied by the support mechanism against the weight of the closure panel increases as the connection rod base structure and the guide blocks move along the length of the at least one resistance member compressing the at least one spring element as the connection rod base structure and the at least one guide block approach the at least one detent. Each detent defines a predetermined location defining the second position of the closure panel.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Referring to the figures, wherein like reference numbers correspond to like or similar components throughout the several views, a support mechanism 101 for a closure panel 102 of a vehicle body 103 is provided.

Figure 1:
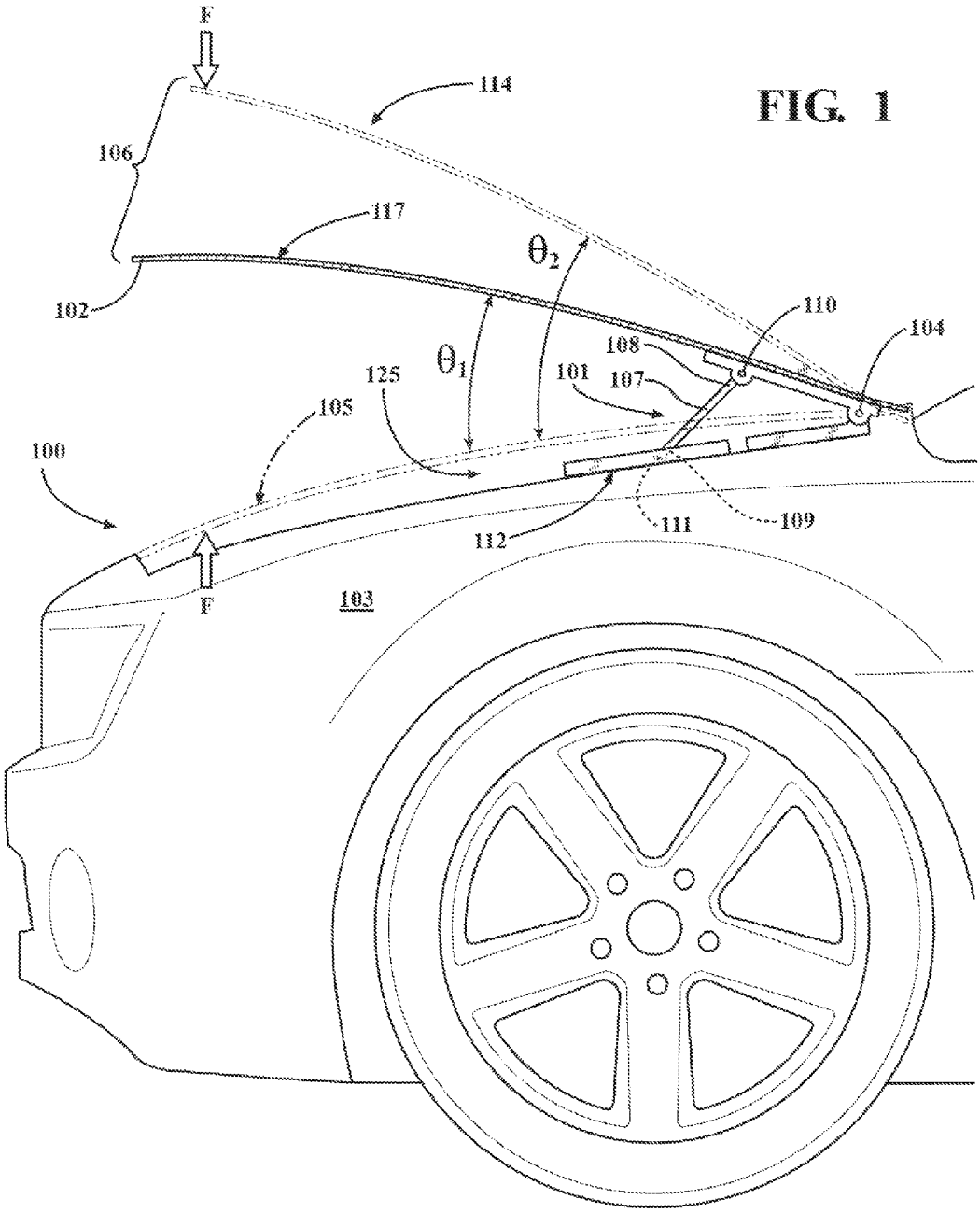
FIG. 1 is a schematic elevation view of the support mechanism for a vehicle closure panel including a connection rod and corresponding counterbalancing device.
Figure 2:
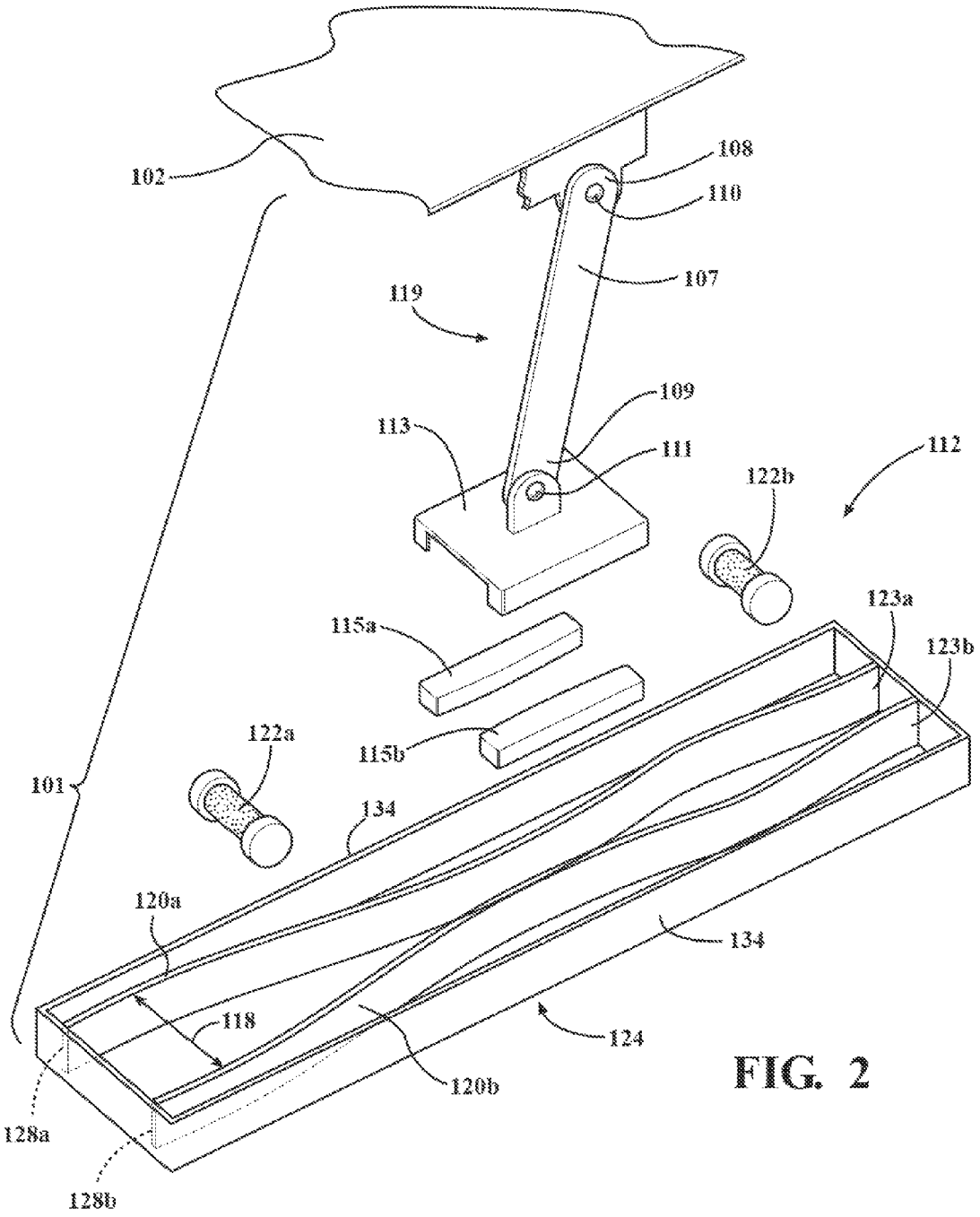
FIG. 2 is an exploded view of the support mechanism.

Referring to FIGS. 1 and 2, the support mechanism 101 is for use in a vehicle 100 having a vehicle body 103 and a vehicle underhood 125. The vehicle closure panel 102 may be pivotally secured to the vehicle body 103 with a hinge 104, pin connection, or the like. The closure panel 102 may be one of a vehicle hood, a rear hatch closure panel, a vehicle trunk, a vehicle liftgate, a truck tailgate, or the like.

The support mechanism 101 is designed to act as a hold open device for a vehicle closure panel 102, as well as a counterbalancing device to reduce and regulate the speed at which the closure panel 102 is moved between a first position 105 and a predetermined location along angles $\theta_1$ and $\theta_2$, comprising a second position 106.

The first position 105 of the vehicle closure panel 102 may be a closed position. The second position 106 may be an open position. The open position may be any open position, such as, but not limited to, a full-open position 117 and a service position 114. In the full-open position 117 the closure panel 102 may extend, relative to the vehicle body 103 along angle $\theta_1$. In the service position 114 the closure panel 102 may extend, relative to the vehicle body 103, along angle $\theta_2$ respectively. In the service position 114, the value of angle $\theta_2$ is greater than the value of angle $\theta_1$ when the closure panel 102 is in the full-open position 117. A user input force F is necessary to initiate movement of the closure panel 102 from the first position 105 to the second position 106 and/or from the second position 106 to the first position 105.

The support mechanism 101 includes: a connection rod assembly 119 and a counterbalancing device 112. The connection rod assembly 119 includes a connection rod 107 and a connection rod base structure 113. The connection rod 107 may have a first end 108 and a second end 109. The connection rod 107 may be pivotally connected to the closure panel 102 at the first end 108 at a first attachment point 110. The connection rod 107 may be operatively connected, by a pin connection, integral formation, or slidably connected at its second end 109 to the connection rod base structure 113 at a second attachment point 111.

The connection rod base structure 113 may be slidable within a guide track 124 formed in the vehicle body 103 within the vehicle underhood 125 (shown in FIG. 1). The guide track 124 may have a pair of opposing walls 134 and may be configured to house and control the movement of the connection rod base structure 113. The connection rod base structure 113 is configured to move linearly with respect to the first attachment point 110.

Referring to FIG. 2, the support mechanism 101 also includes a counterbalancing device 112. The counterbalancing device 112 may include at least one guide block 115*a*, 115*b* and at least one resistance member 120*a*, 120*b*. The counterbalancing device 112 may also include at least one spring element 122*a*, 122*b*.

The at least one guide block 115*a*, 115*b* may be coupled to the connection rod base structure 113 and is configured to be moveable therewith. The connection rod base structure 113 and the at least one guide block 115*a*, 115*b* are moveable together along a length of the at least one resistance member 120*a*, 120*b*. The at least one guide block 115*a*, 115*b* is formed of a first material; the first material may be a frictional material. The first material may be any rigid material such as a polymeric material, metallic material, ceramic material, or the like.

The at least one resistance member 120*a*, 120*b* may run along the length of the guide track 124 and extend from a first end 123*a*, 123*b* to a second end 128*a*, 128*b*. Each resistance member 120*a*, 120*b* may be formed as a dual or single band. The at least one resistance member 120*a*, 120*b* may be formed of a second material; the second material may be a frictional material. The second material may be a strong but flexible polymer or metallic material such as steel or nylon.

The at least one resistance member 120*a*, 120*b* may be operatively connected at each of the first end 123*a*, 123*b* and second end 128*a*, 128*b* to an end plate 121, 127. The at least one resistance member 120*a*, 120*b* may move or oscillate along its length between the first end 123*a*, 123*b* and the second end 128*a*, 128*b*.

Each resistance member 120*a*, 120*b* is configured to interact with the at least one guide block 115*a*, 115*b* as the at least one guide block 115*a*, 115*b*, coupled to the connection rod base structure 113, moves along the length of the at least one resistance member 120*a*, 120*b* between the first end 123*a*, 123*b* and the second end 128*a*, 128*b*, such that the guide block 115*a*, 115*b* engages with the at least one resistance member 120*a*, 120*b* creating an interaction therebetween.

The interaction between the at least one resistance member 120*a*, 120*b* and the at least one guide block 115*a*, 115*b* creates a resistance force sufficient to counterbalance the weight of and reduce the speed of the closure panel 102 as the closure panel 102 is moved between a first position 105 and a second position 106. The resistance force may be one or more of a mechanical resistance force and a frictional resistance force. The speed at which the closure panel 102 moves between the first position 105 and the second position 106 is defined by the interaction between the first material of the at least one guide block 115*a*, 115*b* and the second material of the at least one resistance member 120*a*, 120*b*.

The at least one spring element 122*a*, 122*b* may be formed of an elastomeric material. The at least one spring element 122*a*, 122*b* may be biasingly positioned with respect to the at least one resistance member 120*a*, 120*b*. For example, the at least one spring member 122*a*, 122*b* may be placed proximate to one of the resistance member first end 123*a*, 123*b* and the resistance member second end 128*a*, 128*b*.

The at least one spring element 122*a*, 122*b* is configured to bias the at least one resistance member 120*a*, 120*b* to increase the counterbalancing force applied against the weight of the closure panel 102. The at least one spring element 122*a*, 122*b* is compressed by the connection rod base structure 113 and the at least one guide block 115*a*, 115*b*, as the connection rod base structure 113 and guide blocks 115*a*, 115*b* move along the length of the at least one resistance member 120*a*, 120*b* and the closure panel 102 moves between a first position 105 and a second position 106.

Multiple spring elements 122*a*, 122*b* may be placed along the length of the at least one resistance member 120*a*, 120*b*. Each spring element 122*a*, 122*b* defines a detent 126. The detent 126 being a defined position where one mechanical part is held in relation to another and is releasable by a user applied force F. The compressed spring element 122*a*, 122*b* biases the at least one resistance member 120*a*, 120*b* such that the resistance force, created by the interaction between the at least one guide block 115*a*, 115*b* and the at least one resistance member 120*a*, 120*b*, increases as the connection rod base structure 113 and the at least one guide block 115*a*, 115*b* approach the at least one detent 126.

Each detent 126 defines a predetermined location which defines the second position 106 (show in FIG. 1) for the closure panel 102. The counterbalancing force applied by the support mechanism 101 against the weight of the closure panel 102 increases as the connection rod base structure 113 and the guide blocks 115*a*, 115*b* approach each detent 126. As such, each detent 126 secures the closure panel 102 in a predetermined position, which may define the second position 106 of the closure panel 102, i.e. a full open position 117, a service position 114, or other predetermined position (shown in FIG. 1). The placement and number of the detents 126 allows the support mechanism 101 to be designed for a wide range of resistance forces utilized by a wide range of vehicle styles, makes, models, and other variations.

Figure 3:
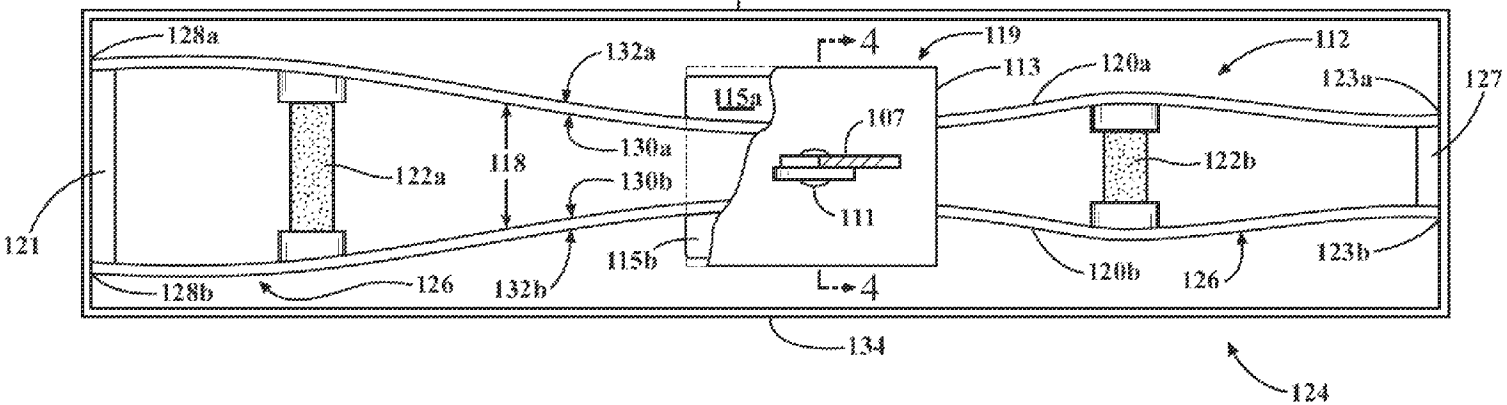
FIG. 3 is a schematic top view of a first example embodiment of the counterbalancing device.
Figure 4:
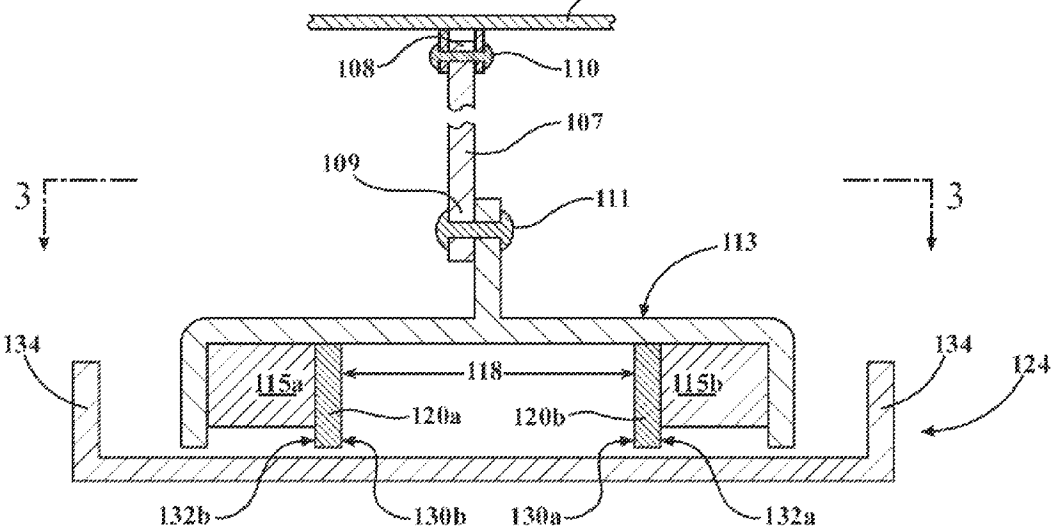
FIG. 4 is a schematic cross-sectional view of a first example embodiment of the counterbalancing device, taken along line 4-4 of FIG. 3.

As shown in FIGS. 3 and 4, a first example embodiment of the support mechanism 101 is shown. In the first example embodiment, the support mechanism 101 has two resistance members 120*a*, 120*b* defining a gap 118 therebetween. Each of the at least two resistance member having a first side 130*a*, 130*b* facing the gap 118 and a second side 132*a*, 132*b* facing away from the gap 118.

In the first example embodiment, the support mechanism 101 further includes two spring elements 122*a*, 122*b* defining two detents 126 and two guide blocks 115*a*, 115*b*. The guide blocks 115*a*, 115*b* are disposed within the connection rod base structure 113 and disposed about the resistance members 120*a*, 120*b*, such that each of the guide blocks 115*a*, 115*b* are directly engaged with the second side 132*a*, 132*b* of one of the respective resistance members 120*a*, 120*b*.

The spring elements 122*a*, 122*b* are disposed within the gap 118 between the resistance members 120*a*, 120*b* and are located proximate the resistance member first ends 123*a*, 123*b* and the resistance member second ends 128*a*, 128*b*. Each of the spring elements 122*a*, 122*b* defines a detent 126 to secure the closure panel 102 in a predetermined position. While two spring elements 122*a*, 122*b* are shown, in each of the respective figures, by way of illustration, it is to be understood that the support mechanism 101 may include any number of spring elements 122*a*, 122*b* placed strategically along the length of the resistance members 120*a*, 120*b*.

In the configuration shown in FIGS. 3 and 4, the spring elements 122*a*, 122*b* are located proximate the first end 123*a*, 123*b* and second end 128*a*, 128*b* of the resistance members

120*a*, 120*b*. In such a configuration, the gap 118 defined between the resistance members 120*a*, 120*b* is constricted by the connection rod base structure 113 and guide blocks 115*a*, 115*b* at the location thereof. As the connection rod base structure 113 and guide blocks 115*a*, 115*b* move along the length of the resistance members 120*a*, 120*b* approaching each detent 126, the gap 118 between the resistance members 120*a*, 120*b* contracts and the resistance members 120*a*, 120*b*, the connection rod base structure 113, and the guide blocks 115*a*, 115*b* work to compress each spring element 122*a*, 122*b*. The compressed spring element 122*a*, 122*b* biases the resistance members 120*a*, 120*b* such that the counterbalancing resistance force increases as the connection rod base structure 113 and the guide blocks 115*a*, 115*b* approach each detent 126 formed by the spring members 122*a*, 122*b* at each of the resistance member first end 123*a*, 123*b* and the resistance member second end 128*a*, 128*b*.

The detents 126 define the first position 105, shown in FIG. 1 as a closed position, and the second position 106, shown in FIG. 1, as a full-open position 117 at an angle $\theta_1$ with respect to the vehicle body 103 and a service position 114 at an angle $\theta_2$ with respect to the vehicle body 103. A user input force F, shown in FIG. 1 is necessary to remove the guide blocks 115*a*, 115*b* and connection rod base structure 113 from a position defined by each respective detent 126.

Figure 5:
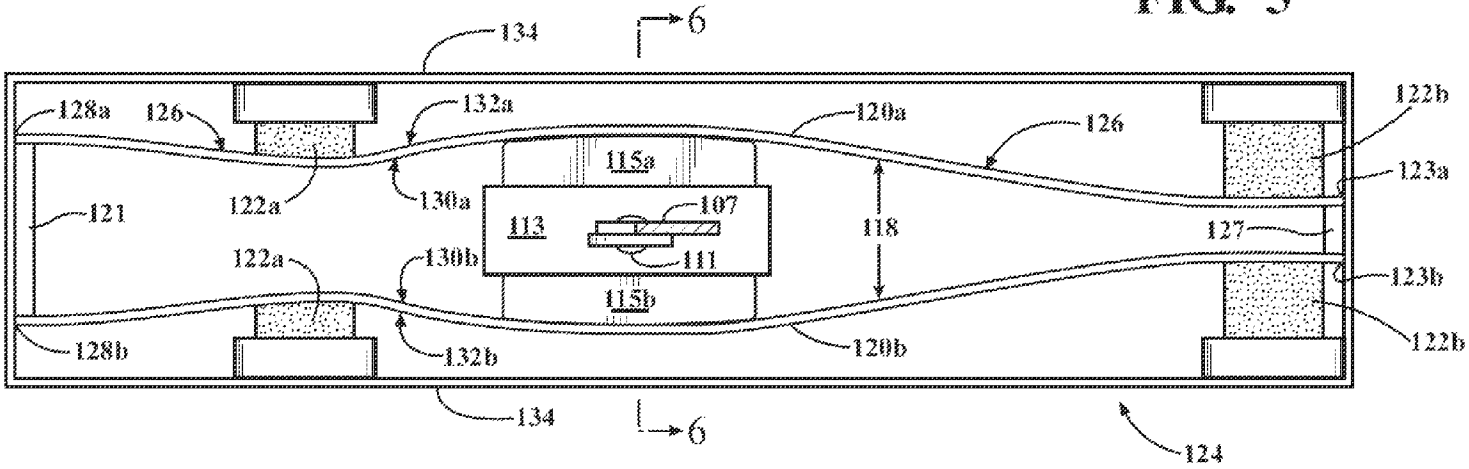
FIG. 5 is a schematic top view of a second example embodiment of the counterbalancing device.
Figure 6:
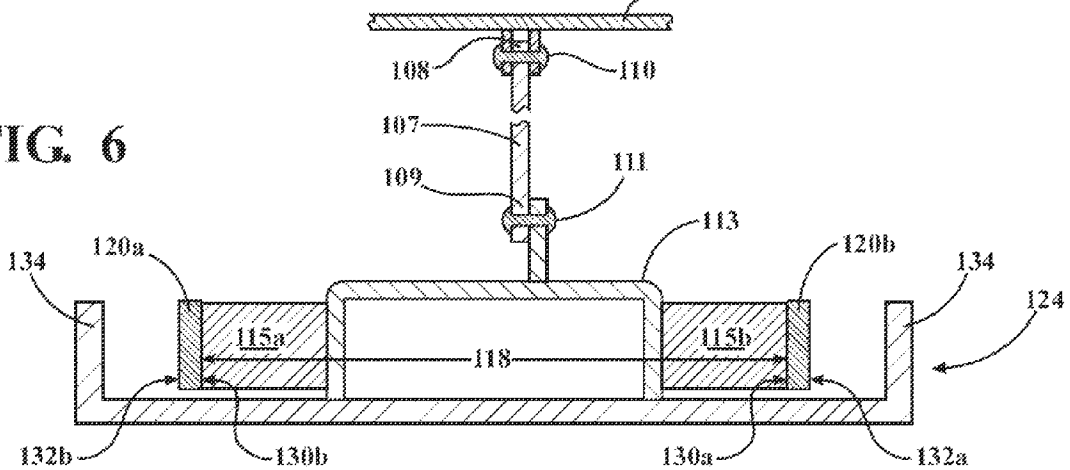
FIG. 6 is a schematic cross-sectional view of the second example embodiment of the counterbalancing device, taken along line 6-6 of FIG. 5.

As shown in FIGS. 5 and 6, a second example embodiment of the support mechanism 101 is shown. In the second example embodiment, the support mechanism 101 has two resistance members 120*a*, 120*b*, two spring elements 122*a*, 122*b* defining two detents 126, and two guide blocks 115*a*, 115*b*. The guide blocks 115*a*, 115*b* are coupled with and placed about the connection rod base structure 113. The guide blocks 115*a*, 115*b* and the connection rod base structure 113 are disposed within the gap 118 defined between the resistance members 120*a*, 120*b*, such that each of the guide blocks 115*a*, 115*b* is directly engaged with the first side 130*a*, 130*b* of one of the at least two resistance members 120*a*, 120*b*.

Each of the spring elements 122*a*, 122*b* are disposed within the guide track 124 between one of the opposing walls 134 and the second side 132*a*, 132*b* of one of the at least two resistance members 120*a*, 120*b*. The spring elements 122*a*, 122*b* are located proximate each of the resistance member first ends 123*a*, 123*b* and the resistance member second ends 128*a*, 128*b*. Each of the spring elements 122*a*, 122*b* defines a detent 126 to secure the closure panel 102 in a predetermined position. While two spring elements 122*a*, 122*b* are shown, in each of the respective figures, by way of illustration, it is to be understood that the support mechanism 101 may include any number of spring elements 122*a*, 122*b* placed strategically along the length of the resistance members 120*a*, 120*b*.

In the configuration shown in FIGS. 5 and 6 the spring elements 122*a*, 122*b* are located proximate the resistance member 120*a*, 120*b* first ends 123*a*, 123*b* and second ends 128*a*, 128*b*. In such a configuration, the gap 118 between the resistance members 120*a*, 120*b* is expanded by the connection rod base structure 113 and guide blocks 115*a*, 115*b* at the location thereof. As the connection rod base structure 113 and guide blocks 115*a*, 115*b* move along the length of the resistance members 120*a*, 120*b* approaching each detent 126, the gap 118 between the resistance members 120*a*, 120*b* expands and the resistance members 120*a*, 120*b*, the connection rod base structure 113, and the guide blocks 115*a*, 115*b* work to compress the spring elements 122*a*, 122*b*. Each compressed spring element 122*a*, 122*b* biases each of the resistance members 120*a*, 120*b* such that the counterbalancing resistance force increases as the connection rod base structure 113 and the guide blocks 115*a*, 115*b* approach each detent 126 formed by the spring members 122*a*, 122*b* at each of the resistance member first end 123*a*, 123*b* and the resistance member second end 128*a*, 128*b*.

One detent 126 defines the first position 105, shown in FIG. 1 as a closed position. Another detent 126 defines the second position 106, shown in FIG. 1, as a full open position 117 at an angle $\theta_1$ with respect to the vehicle body 103 and a service position 114 at an angle $\theta_2$ with respect to the vehicle body 103. A user input force F, shown in FIG. 1 is necessary to remove the guide blocks 115*a*, 115*b* and connection rod base structure 113 from a predetermined position defined by each respective detent 126.

The support mechanism 101 described herein is operable to reduce the speed at which the closure panel 102 travels between a first position 105 and a second position 106. The speed at which the closure panel 102 moves between the first position 105 and the second position 106 is defined by the interaction between the at least one guide block 115*a*, 115*b* formed of a first material and the at least one resistance member 120*a*, 120*b* formed of a second material.

The support mechanism 101 utilizes simple structure, which need not include pneumatic or gas-strut elements. The elimination of pneumatic elements allows the counterbalancing device 112 to act as a linear spring to provide a smooth power output and controlled movement of the closure panel 102 between the first position 105 and second position 106 in a multitude of temperatures and environmental conditions. This speed control of the closure panel 102 limits the amount of over travel of the closure panel 102 that may result from an uncontrolled movement between the first position 105 and the second position 106.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A support mechanism for a moveable closure panel of a vehicle body, the support mechanism comprising:

a connection rod assembly including a connection rod and a connection rod base structure, the connection rod operatively connected to the closure panel and the connection rod base structure;

a counterbalancing device including:

at least two guide blocks disposed within the connection rod base structure for movement therewith;

at least two resistance members defining a gap therebetween, such that each of the resistance members has a first end, a second end, a first side facing the gap, and a second side facing away from the gap, the resistance members being flexible along a length, such that the length is defined between the first end and the second end;

wherein the guide blocks and the connection rod base structure are moveable along the length of the resistance members, such that each of the guide blocks directly engages the second side of one of the resistance members creating an interaction therebetween; and wherein the interaction between the guide blocks and the resistance members creates a resistance force sufficient to counterbalance the closure panel as the connection rod base structure moves along the length of the resistance members.

2. The support mechanism of claim 1 wherein the guide blocks are composed of a first material and the resistance members are composed of a second material, wherein the interaction between the first material of the guide blocks and the second material of the resistance members creates the resistance force sufficient to counterbalance the closure panel as the connection rod base structure and the guide blocks move along the length of and engage the resistance members.

3. The support mechanism of claim 2 wherein the first material is a frictional material and wherein the second material is one of steel and nylon.

4. The support mechanism of claim 1 wherein the closure panel is moveable with respect to the vehicle body between a first position and a second position, and wherein the connection rod assembly and the counterbalancing device reduce the speed of the closure panel as the closure panel moves between the first position and the second position.

5. The support mechanism of claim 1 wherein the counterbalancing device further includes at least one spring element biasingly positioned with respect to at least one of the resistance members, the at least one spring element defining at least one detent.

6. The support mechanism of claim 5 wherein the connection rod base structure and the guide blocks compress the at least one spring element as the connection rod base structure and the guide blocks move along the length of the resistance members and approach the at least one detent, such that the compressed spring element biases at least one of the resistance members to increase the resistance force as the connection rod base structure and the guide blocks approach the at least one detent.

7. The support mechanism of claim 5 wherein the at least one detent defines a predetermined location for the closure panel second position.

8. The support mechanism of claim 5 wherein the support mechanism includes at least two spring elements disposed within the gap between the at least two resistance members.

9. A vehicle comprising:

a vehicle body;

a closure panel operatively connected to the vehicle body with a hinge;

a connection rod assembly including a connection rod and a connection rod base structure, the connection rod operatively connected to the closure panel at a first attachment point and operatively connected to the connection rod base structure at a second attachment point, the connection rod base structure configured to move linearly with respect to the first attachment point;

a counterbalancing device including:

at least two guide blocks composed of a first material and fitted within the connection rod base structure for movement therewith;

at least two resistance members composed of a second material and defining a gap therebetween, such that each of the resistance members has a first side facing the gap and a second side facing away from the gap, the resistance members configured to interact with the guide blocks to create a resistance force sufficient to counterbalance the closure panel as the connection rod base structure moves linearly with respect to the first attachment point;

wherein the guide blocks and the connection rod base structure are moveable along the length of the resistance members, such that each of the guide blocks is directly engaged with the second side of one of the resistance members;

at least one spring element biasingly positioned with respect to the resistance members, the at least one spring element defining at least one detent configured to bias the resistance members against the guide blocks to sufficiently counterbalance the closure panel as the connection rod base structure and the guide blocks move along the length of the resistance members;

wherein the closure panel is pivotable with respect to the vehicle body between a first position and a second position, the connection rod and counterbalancing device being operable to hold the closure panel in the second position;

wherein the counterbalancing device is operable to reduce the speed of the closure panel, as the closure panel moves between the first position and a second position; and wherein the speed at which the closure panel moves between the first position and the second position is defined by the interaction between the first material of the guide blocks and the second material of the resistance members.

10. The vehicle of claim 9 wherein each detent defines a predetermined location for the closure panel second position, wherein the closure panel second position is one of a full open position and a service position.

11. The vehicle of claim 9 wherein the at least one spring element is disposed within the gap between the at least two resistance members.

12. The vehicle of claim 9 wherein the closure panel is one of a vehicle hood, a vehicle trunk panel, a rear hatch closure panel, a tailgate, and a liftgate.

13. A vehicle comprising:

a vehicle body;

a closure panel operatively connected to the vehicle body with a hinge;

a connection rod assembly including a connection rod and a connection rod base structure, the connection rod operatively connected to the closure panel at a first attachment point and operatively connected to the connection rod base structure at a second attachment point, the connection rod base structure configured to move linearly with respect to the first attachment point;

a counterbalancing device including:

at least one guide block composed of a first material and coupled to the connection rod base structure for movement therewith;

at least two resistance members composed of a second material and defining a gap therebetween, such that each of the resistance members has a first side facing the gap and a second side facing away from the gap, the resistance members configured to interact with the at least one guide block to create a resistance force sufficient to counterbalance the closure panel as the connection rod base structure moves linearly with respect to the first attachment point;

wherein the at least one guide block and the connection rod base structure are moveable along the length of the at least two resistance members;

a guide track having a pair of opposing walls;

at least one spring element disposed within the guide track between one of the opposing walls and the second side of one of the at least two resistance members and biasingly positioned with respect to at least one of the resistance members, the at least one spring element defining at least one detent and configured to bias at least one of the resistance members against the at least one guide block to sufficiently counterbalance the closure panel as the connection rod base structure and the at least one guide block move along the length of the resistance members;

wherein the closure panel is pivotable with respect to the vehicle body between a first position and a second position, the connection rod and counterbalancing device being operable to hold the closure panel in the second position;

wherein the counterbalancing device is operable to reduce the speed of the closure panel, as the closure panel moves between the first position and a second position; and wherein the speed at which the closure panel moves between the first position and the second position is defined by the interaction between the first material of the at least one guide block and the second material of the resistance members.

14. The vehicle of claim 13 wherein:

the at least one guide block is further defined as two guide blocks being coupled with and placed about the connection rod base structure, the guide blocks and the connection rod base structure being disposed within the gap defined between the at least two resistance members such that each of the guide blocks is directly engaged with the first side of one of the at least two resistance members.

15. The vehicle of claim 13 wherein each detent defines a predetermined location for the closure panel second position, wherein the closure panel second position is one of a full open position and a service position.

16. The vehicle of claim 13 wherein the closure panel is one of a vehicle hood, a vehicle trunk panel, a rear hatch closure panel, a tailgate, and a liftgate.

* * * * *